US008289250B2

(12) United States Patent
Zehner et al.

(10) Patent No.: US 8,289,250 B2
(45) Date of Patent: Oct. 16, 2012

(54) METHODS FOR DRIVING ELECTRO-OPTIC DISPLAYS

(75) Inventors: Robert W. Zehner, Belmont, MA (US); Karl R. Amundson, Cambridge, MA (US); Theodore A. Sjodin, Waltham, MA (US); Holly G. Gates, Somerville, MA (US)

(73) Assignee: E INK Corporation, Cambridge, MA (US)

( * ) Notice: Subject to any disclaimer, the term of this patent is extended or adjusted under 35 U.S.C. 154(b) by 1153 days.

(21) Appl. No.: 11/936,326

(22) Filed: Nov. 7, 2007

(65) Prior Publication Data

US 2008/0129667 A1 Jun. 5, 2008

Related U.S. Application Data

(60) Continuation-in-part of application No. 11/425,408, filed on Jun. 21, 2006, now Pat. No. 7,733,311, which is a division of application No. 10/814,205, filed on Mar. 31, 2004, now Pat. No. 7,119,772.

(60) Provisional application No. 60/864,904, filed on Nov. 8, 2006.

(51) Int. Cl.
*G09G 3/36* (2006.01)

(52) U.S. Cl. ..... 345/87; 345/89; 349/168; 359/296

(58) Field of Classification Search ..... 345/30, 345/55, 84, 87–100, 107, 214, 690; 349/10, 349/24, 19, 33, 34, 85, 168, 175; 359/296
See application file for complete search history.

(56) References Cited

U.S. PATENT DOCUMENTS

| | | | |
|---|---|---|---|
| 3,668,106 | A | 6/1972 | Ota |
| 3,756,693 | A | 9/1973 | Ota |
| 3,767,392 | A | 10/1973 | Ota |
| 3,792,308 | A | 2/1974 | Ota |
| 3,870,517 | A | 3/1975 | Ota et al. |
| 3,892,568 | A | 7/1975 | Ota |
| 4,418,346 | A | 11/1983 | Batchelder |
| 4,828,617 | A | 5/1989 | Csillag et al. |
| 5,679,821 | A | 10/1997 | Takei et al. |
| 5,745,094 | A | 4/1998 | Gordon, II et al. |
| 5,760,761 | A | 6/1998 | Sheridon |
| 5,777,782 | A | 7/1998 | Sheridon |
| 5,808,783 | A | 9/1998 | Crowley |

(Continued)

FOREIGN PATENT DOCUMENTS

DE 25 23 763 12/1976

(Continued)

OTHER PUBLICATIONS

Amundson, K., "Electrophoretic Imaging Films for Electronic Paper Displays" in Crawford, G. ed. Flexible Flat Panel Displays, John Wiley & Sons, Ltd., Hoboken, NJ: 2005.

(Continued)

*Primary Examiner* — Kimnhung Nguyen
(74) *Attorney, Agent, or Firm* — David J. Cole

(57) ABSTRACT

A bistable electro-optic display is updated by writing an image on the display using a first drive scheme capable of driving pixels to multiple gray levels, and thereafter varied using a second drive scheme using only two gray levels, at least one of which is not an extreme optical state of the pixel.

23 Claims, 3 Drawing Sheets

U.S. PATENT DOCUMENTS

| | | | | |
|---|---|---|---|---|
| 5,872,552 | A | 2/1999 | Gordon, II et al. | |
| 5,912,283 | A | 6/1999 | Hashizume et al. | |
| 5,930,026 | A | 7/1999 | Jacobson et al. | |
| 5,961,804 | A | 10/1999 | Jacobson et al. | |
| 6,017,584 | A | 1/2000 | Albert et al. | |
| 6,054,071 | A | 4/2000 | Mikkelsen, Jr. | |
| 6,055,091 | A | 4/2000 | Sheridon et al. | |
| 6,067,185 | A | 5/2000 | Albert et al. | |
| 6,097,531 | A | 8/2000 | Sheridon | |
| 6,118,426 | A | 9/2000 | Albert et al. | |
| 6,120,588 | A | 9/2000 | Jacobson | |
| 6,120,839 | A | 9/2000 | Comiskey et al. | |
| 6,124,851 | A | 9/2000 | Jacobson | |
| 6,128,124 | A | 10/2000 | Silverman | |
| 6,130,773 | A | 10/2000 | Jacobson et al. | |
| 6,130,774 | A | 10/2000 | Albert et al. | |
| 6,137,467 | A | 10/2000 | Sheridon et al. | |
| 6,144,361 | A | 11/2000 | Gordon, II et al. | |
| 6,147,791 | A | 11/2000 | Sheridon | |
| 6,166,711 | A | 12/2000 | Odake | |
| 6,172,798 | B1 | 1/2001 | Albert et al. | |
| 6,177,921 | B1 | 1/2001 | Comiskey et al. | |
| 6,184,856 | B1 | 2/2001 | Gordon, II et al. | |
| 6,225,971 | B1 | 5/2001 | Gordon, II et al. | |
| 6,232,950 | B1 | 5/2001 | Albert et al. | |
| 6,241,921 | B1 | 6/2001 | Jacobson et al. | |
| 6,249,271 | B1 | 6/2001 | Albert et al. | |
| 6,252,564 | B1 | 6/2001 | Albert et al. | |
| 6,262,706 | B1 | 7/2001 | Albert et al. | |
| 6,262,833 | B1 | 7/2001 | Loxley et al. | |
| 6,271,823 | B1 | 8/2001 | Gordon, II et al. | |
| 6,300,932 | B1 | 10/2001 | Albert | |
| 6,301,038 | B1 | 10/2001 | Fitzmaurice et al. | |
| 6,312,304 | B1 | 11/2001 | Duthaler et al. | |
| 6,312,971 | B1 | 11/2001 | Amundson et al. | |
| 6,320,565 | B1 | 11/2001 | Albu et al. | |
| 6,323,989 | B1 | 11/2001 | Jacobson et al. | |
| 6,327,072 | B1 | 12/2001 | Comiskey et al. | |
| 6,376,828 | B1 | 4/2002 | Comiskey | |
| 6,377,387 | B1 | 4/2002 | Duthaler et al. | |
| 6,392,785 | B1 | 5/2002 | Albert et al. | |
| 6,392,786 | B1 | 5/2002 | Albert | |
| 6,413,790 | B1 | 7/2002 | Duthaler et al. | |
| 6,422,687 | B1 | 7/2002 | Jacobson | |
| 6,445,374 | B2 | 9/2002 | Albert et al. | |
| 6,445,489 | B1 | 9/2002 | Jacobson et al. | |
| 6,459,418 | B1 | 10/2002 | Comiskey et al. | |
| 6,473,072 | B1 | 10/2002 | Comiskey et al. | |
| 6,480,182 | B2 | 11/2002 | Turner et al. | |
| 6,498,114 | B1 | 12/2002 | Amundson et al. | |
| 6,504,524 | B1 * | 1/2003 | Gates et al. | 345/107 |
| 6,506,438 | B2 | 1/2003 | Duthaler et al. | |
| 6,512,354 | B2 | 1/2003 | Jacobson et al. | |
| 6,515,649 | B1 | 2/2003 | Albert et al. | |
| 6,518,949 | B2 | 2/2003 | Drzaic | |
| 6,521,489 | B2 | 2/2003 | Duthaler et al. | |
| 6,531,997 | B1 | 3/2003 | Gates et al. | |
| 6,535,197 | B1 | 3/2003 | Comiskey et al. | |
| 6,538,801 | B2 | 3/2003 | Jacobson et al. | |
| 6,545,291 | B1 | 4/2003 | Amundson et al. | |
| 6,580,545 | B2 | 6/2003 | Morrison et al. | |
| 6,639,578 | B1 | 10/2003 | Comiskey et al. | |
| 6,652,075 | B2 | 11/2003 | Jacobson | |
| 6,657,772 | B2 | 12/2003 | Loxley | |
| 6,664,944 | B1 | 12/2003 | Albert et al. | |
| D485,294 | S | 1/2004 | Albert | |
| 6,672,921 | B1 | 1/2004 | Liang et al. | |
| 6,680,725 | B1 | 1/2004 | Jacobson | |
| 6,683,333 | B2 | 1/2004 | Kazlas et al. | |
| 6,693,620 | B1 | 2/2004 | Herb et al. | |
| 6,704,133 | B2 | 3/2004 | Gates et al. | |
| 6,710,540 | B1 | 3/2004 | Albert et al. | |
| 6,721,083 | B2 | 4/2004 | Jacobson et al. | |
| 6,724,519 | B1 | 4/2004 | Comiskey et al. | |
| 6,727,881 | B1 | 4/2004 | Albert et al. | |
| 6,738,050 | B2 | 5/2004 | Comiskey et al. | |
| 6,750,473 | B2 | 6/2004 | Amundson et al. | |
| 6,753,999 | B2 | 6/2004 | Zehner et al. | |
| 6,788,449 | B2 | 9/2004 | Liang et al. | |
| 6,816,147 | B2 | 11/2004 | Albert | |
| 6,819,471 | B2 | 11/2004 | Amundson et al. | |
| 6,822,782 | B2 | 11/2004 | Honeyman et al. | |
| 6,825,068 | B2 | 11/2004 | Denis et al. | |
| 6,825,829 | B1 | 11/2004 | Albert et al. | |
| 6,825,970 | B2 | 11/2004 | Goenaga et al. | |
| 6,831,769 | B2 | 12/2004 | Holman et al. | |
| 6,839,158 | B2 | 1/2005 | Albert et al. | |
| 6,842,167 | B2 | 1/2005 | Albert et al. | |
| 6,842,279 | B2 | 1/2005 | Amundson | |
| 6,842,657 | B1 | 1/2005 | Drzaic et al. | |
| 6,864,875 | B2 | 3/2005 | Drzaic et al. | |
| 6,865,010 | B2 | 3/2005 | Duthaler et al. | |
| 6,866,760 | B2 | 3/2005 | Paolini Jr. et al. | |
| 6,870,657 | B1 | 3/2005 | Fitzmaurice et al. | |
| 6,870,661 | B2 | 3/2005 | Pullen et al. | |
| 6,900,851 | B2 | 5/2005 | Morrison et al. | |
| 6,922,276 | B2 | 7/2005 | Zhang et al. | |
| 6,950,220 | B2 | 9/2005 | Abramson et al. | |
| 6,958,848 | B2 | 10/2005 | Cao et al. | |
| 6,967,640 | B2 | 11/2005 | Albert et al. | |
| 6,980,196 | B1 | 12/2005 | Turner et al. | |
| 6,982,178 | B2 | 1/2006 | LeCain et al. | |
| 6,987,603 | B2 | 1/2006 | Paolini, Jr. et al. | |
| 6,995,550 | B2 | 2/2006 | Jacobson et al. | |
| 7,002,728 | B2 | 2/2006 | Pullen et al. | |
| 7,012,600 | B2 | 3/2006 | Zehner et al. | |
| 7,012,735 | B2 | 3/2006 | Honeyman et al. | |
| 7,023,420 | B2 * | 4/2006 | Comiskey et al. | 345/107 |
| 7,030,412 | B1 | 4/2006 | Drzaic et al. | |
| 7,030,854 | B2 | 4/2006 | Baucom et al. | |
| 7,034,783 | B2 | 4/2006 | Gates et al. | |
| 7,038,655 | B2 | 5/2006 | Herb et al. | |
| 7,061,663 | B2 | 6/2006 | Cao et al. | |
| 7,071,913 | B2 | 7/2006 | Albert et al. | |
| 7,075,502 | B1 | 7/2006 | Drzaic et al. | |
| 7,075,703 | B2 | 7/2006 | O'Neil et al. | |
| 7,079,305 | B2 | 7/2006 | Paolini, Jr. et al. | |
| 7,106,296 | B1 | 9/2006 | Jacobson | |
| 7,109,968 | B2 | 9/2006 | Albert et al. | |
| 7,110,163 | B2 | 9/2006 | Webber et al. | |
| 7,110,164 | B2 | 9/2006 | Paolini, Jr. et al. | |
| 7,116,318 | B2 | 10/2006 | Amundson et al. | |
| 7,116,466 | B2 | 10/2006 | Whitesides et al. | |
| 7,119,759 | B2 | 10/2006 | Zehner et al. | |
| 7,119,772 | B2 | 10/2006 | Amundson et al. | |
| 7,148,128 | B2 | 12/2006 | Jacobson | |
| 7,167,155 | B1 | 1/2007 | Albert et al. | |
| 7,170,670 | B2 | 1/2007 | Webber | |
| 7,173,752 | B2 | 2/2007 | Doshi et al. | |
| 7,176,880 | B2 | 2/2007 | Amundson et al. | |
| 7,180,649 | B2 | 2/2007 | Morrison et al. | |
| 7,190,008 | B2 | 3/2007 | Amundson et al. | |
| 7,193,625 | B2 | 3/2007 | Danner et al. | |
| 7,202,847 | B2 | 4/2007 | Gates | |
| 7,202,991 | B2 | 4/2007 | Zhang et al. | |
| 7,206,119 | B2 | 4/2007 | Honeyman et al. | |
| 7,223,672 | B2 | 5/2007 | Kazlas et al. | |
| 7,230,750 | B2 | 6/2007 | Whitesides et al. | |
| 7,230,751 | B2 | 6/2007 | Whitesides et al. | |
| 7,236,290 | B1 | 6/2007 | Zhang et al. | |
| 7,236,291 | B2 | 6/2007 | Kaga et al. | |
| 7,236,292 | B2 | 6/2007 | LeCain et al. | |
| 7,242,513 | B2 | 7/2007 | Albert et al. | |
| 7,247,379 | B2 | 7/2007 | Pullen et al. | |
| 7,256,766 | B2 | 8/2007 | Albert et al. | |
| 7,259,744 | B2 | 8/2007 | Arango et al. | |
| 7,265,895 | B2 | 9/2007 | Miyazaki et al. | |
| 7,280,094 | B2 | 10/2007 | Albert | |
| 2001/0050666 | A1 * | 12/2001 | Huang et al. | 345/88 |
| 2002/0060321 | A1 | 5/2002 | Kazlas et al. | |
| 2002/0090980 | A1 | 7/2002 | Wilcox et al. | |
| 2002/0171620 | A1 | 11/2002 | Gordon, II et al. | |
| 2003/0102858 | A1 | 6/2003 | Jacobson et al. | |
| 2004/0105036 | A1 | 6/2004 | Danner et al. | |
| 2004/0119681 | A1 | 6/2004 | Albert et al. | |
| 2004/0263947 | A1 | 12/2004 | Drzaic et al. | |
| 2005/0012980 | A1 | 1/2005 | Wilcox et al. | |

| | | | |
|---|---|---|---|
| 2005/0122284 | A1 | 6/2005 | Gates et al. |
| 2005/0122306 | A1 | 6/2005 | Wilcox et al. |
| 2005/0122563 | A1 | 6/2005 | Honeyman et al. |
| 2005/0156340 | A1 | 7/2005 | Valianatos et al. |
| 2005/0179642 | A1 | 8/2005 | Wilcox et al. |
| 2005/0253777 | A1 | 11/2005 | Zehner et al. |
| 2005/0259068 | A1 | 11/2005 | Nihei et al. |
| 2006/0087479 | A1 | 4/2006 | Sakurai et al. |
| 2006/0087489 | A1 | 4/2006 | Sakurai et al. |
| 2006/0087718 | A1 | 4/2006 | Takagi et al. |
| 2006/0152474 | A1 | 7/2006 | Saito et al. |
| 2006/0181504 | A1 | 8/2006 | Kawai |
| 2006/0209008 | A1 | 9/2006 | Nihei et al. |
| 2006/0214906 | A1 | 9/2006 | Kobayashi et al. |
| 2006/0231401 | A1 | 10/2006 | Sakurai et al. |
| 2006/0238488 | A1 | 10/2006 | Nihei et al. |
| 2006/0263927 | A1 | 11/2006 | Sakurai et al. |
| 2007/0013683 | A1 | 1/2007 | Zhou et al. |
| 2007/0052757 | A1 | 3/2007 | Jacobson |
| 2007/0091417 | A1 | 4/2007 | Cao et al. |
| 2007/0091418 | A1 | 4/2007 | Danner et al. |
| 2007/0097489 | A1 | 5/2007 | Doshi et al. |
| 2007/0103427 | A1 | 5/2007 | Zhou et al. |
| 2007/0195399 | A1 | 8/2007 | Aylward et al. |
| 2007/0211002 | A1 | 9/2007 | Zehner et al. |

FOREIGN PATENT DOCUMENTS

| | | | |
|---|---|---|---|
| EP | 1 099 207 | B1 | 3/2002 |
| EP | 1 145 072 | B1 | 5/2003 |
| JP | 03-091722 | A | 4/1991 |
| JP | 03-096925 | A | 4/1991 |
| JP | 05-173194 | A | 7/1993 |
| JP | 06-233131 | A | 8/1994 |
| JP | 09-016116 | A | 1/1997 |
| JP | 09-185087 | A | 7/1997 |
| JP | 09-230391 | A | 9/1997 |
| JP | 11-113019 | A | 4/1999 |
| WO | WO 99/10870 | | 3/1999 |
| WO | WO 00/36560 | | 6/2000 |
| WO | WO 00/38000 | | 6/2000 |
| WO | WO 00/67110 | | 11/2000 |
| WO | WO 01/07961 | | 2/2001 |
| WO | WO 2004/099862 | | 11/2004 |
| WO | WO 2011/146920 | | 11/2011 |

OTHER PUBLICATIONS

Amundson, K., et al., "Flexible, Active-Matrix Display Constructed Using a Microencapsulated Electrophoretic Material and an Organic-Semiconductor-Based Backplane", SID 01 Digest, 160 (Jun. 2001).
Antia, M., "Switchable Reflections Make Electronic Ink", Science, 285, 658 (1999).
Au, J. et al,, "Ultra-Thin 3.1-in, Active-Matrix Electronic Ink Display for Mobile Devices", IDW'02, 223 (2002).
Bach, U., et al., "Nanornaterials-Based Electrochromics for Paper-Quality Display", Adv. Mater, 14(11), 845 (2002).
Bouchard, A. et al., "High-Resolution Microencapsulated Electrophoretic Display on Silicon", SID 04 Digest, 651 (2004).
Caillot, E. et al. "Active Matrix Electrophoretic Information Display for High Performance Mobile Devices", IDMC Proceedings (2003).
Chen, Y., et al., "A Conformable Electronic Ink Display using a Foil-Based a-Si TFT Array", SID 01 Digest, 157 (Jun. 2001).
Comiskey, B., et al., "An electrophoretic ink for all-printed reflective electronic displays", Nature, 394, 253 (1998).
Comiskey, B., et al., "Electrophoretic Ink: A Printable Display Material", SID 97 Digest (1997), p. 75.
Danner, G.M. et al., "Reliability Performance for Microencapsulated Electrophoretic Displays with Simulated Active Matrix Drive", SID 03 Digest, 573 (2003).
Drzaic, P., et al., "A Printed and Rollable Bistable Electronic Display", SID 98 Digest (1998), p. 1131.
Duthaler, G., et al., "Active-Matrix Color Displays Using Electrophoretic Ink and Color Filters", SID 02 Digest, 1374 (2002).
Gates, H. et al., "A5 Sized Electronic Paper Display for Document Viewing", SID 05 Digest, (2005).
Hayes, R.A., et al., "Video-Speed Electronic Paper Based on Electrowetting", Nature, vol. 425, Sep. 25, pp. 383-385 (2003).
Henzen, A. et al., "An Electronic Ink Low Latency Drawing Tablet", SID 04 Digest, 1070 (2004).
Henzen, A. et al., "Development of Active Matrix Electronic Ink Displays for Handheld Devices", SID 03 Digest, 176, (2003).
Henzen, A. et al., "Development of Active Matrix Electronic Ink Displays for Smart Handheld Applications", IDW'02, 227 (2002).
Hunt, R.W.G., "Measuring Color", 3d. Edn, Fountain Press (ISBN 0 86343 387 1), p. 63 (1998).
Jacobson, J., et al., "The last book", IBM Systems J., 36, 457 (1997).
Jo, G-R et al., "Toner Display Based on Particle Movements", Chem. Mater, 14, 664 (2002).
Johnson, M. et al., "High Quality Images on Electronic Paper Displays", SID 05 Digest, 1666 (2005).
Kazias, P. et al., "Card-size Active-matrix Electronic Ink Display", Eurodisplay 2002, 259 (2002).
Kazlas, P., et al., "12.1" SVGA Microencapsulated Electrophoretic Active Matrix Display for information Applicances, SID 01 Digest, 152 (Jun. 2001).
Kitamura, T., et al., "Electrical toner movement for electronic paper-like display", Asia Display/IDW '01, p. 1517, Paper HCS1-1 (2001).
Mossman, M.A., et al., "A New Reflective Color Display Technique Based on Total Internal Reflection and Substractive Color Filtering", SID 01 Digest, 1054 (2001).
O'Regan, B. et al., "A Low Cost, High-efficiency Solar Cell Based on Dye-sensitized colloidal TiO2 Films", Nature, vol. 353, Oct. 24, 1991, 773-740.
Pitt, M.G., et al,, "Power Consumption of Microencapsulated Eiectrophoretic Displays for Smart Handheld Applications", SID 02 Digest, 1378 (2002).
Poor, A., "Feed forward makes LCDs Faster", available at http://www.extremetech.com/article2/0,3973,10085,00.asp.
Shiffman, R.R., et al., "An Electrophoretic Image Display with Internal NMOS Address Logic and Display Drivers," Proceedings of the SID, 1984, vol. 25, 105 (1984).
Singer, B., et al., "An X-Y Addressable Electrophoretic Display," Proceedings of the SID, 18, 255 (1977).
Webber, R., "Image Stability in Active-Matrix Microencapsulated Electrophoretic Displays", SID 02 Digest, 126 (2002).
Whitesides, T. et al., "Towards Video-rate Microencapsulated Dual-Particle Electrophoretic Displays", SID 04 Digest, 133 (2004).
Wood, D., "An Electrochromic Renaissance?" Information Display, 18(3), 24 (Mar. 2002).
Yamaguchi, Y., et al., "Toner display using insulative particles charged triboelectrically", Asia Display/IDW '01, p. 1729, Paper AMD4-4 (2001).
Zehner, R. et al., "Drive Waveforms for Active Matrix Electrophoretic Displays", SID 03 Digest, 036 842 (2003).

* cited by examiner

METHODS FOR DRIVING ELECTRO-OPTIC DISPLAYS

REFERENCE TO RELATED APPLICATIONS

This application is a continuation-in-part of application Ser. No. 11/425,408, filed Jun. 21, 2006 (Publication No. 2006/0232531), now U.S. Pat. No. 7,733,311), which in turn in a divisional of application Ser. No. 10/814,205, filed Mar. 31, 2004 (now U.S. Pat. No. 7,119,772). This application also claims benefit of copending Application Ser. No. 60/864,904, filed Nov. 8, 2006.

This application is also related to:

(a) U.S. Pat. No. 6,504,524;
(b) U.S. Pat. No. 6,512,354;
(c) U.S. Pat. No. 6,531,997;
(d) U.S. Pat. No. 6,995,550;
(e) U.S. Pat. No. 7,012,600, and the related Applications Publication Nos. 2005/0219184 (now U.S. Pat. No. 7,312,794); 2006/0139310(now U.S. Pat. No. 7,733,335); and 2006/0139311 (now U.S. Pat. No. 7,688,297);
(f) U.S. Pat. No. 7,034,783;
(g) U.S. Pat. No. 7,193,625, and the related Application Publication No. 2007/0091418;
(h) U.S. Pat. No. 7,259,744;
(i) application Ser. No. 10/879,335 (Publication No. 2005/0024353, now U.S. Pat. No. 7,528,822);
(j) copending application Ser. No. 10/904,707 (Publication No. 2005/0179642);
(k) application Ser. No. 10/906,985 (Publication No. 2005/0212747, now U.S. Pat. No. 7,492,339);
(l) application Ser. No. 10/907,140 (Publication No. 2005/0213191, now U.S. Pat. No. 7,327,511);
(m) application Ser. No. 10/907,171 (Publication No. 2005/0152018, now U.S. Pat. No. 7,787,169);
(n) application Ser. No. 11/161,715 (Publication No. 2005/0280626, now U.S. Pat. No. 7,952,557)
(o) application Ser. No. 11/162,188 (Publication No. 2006/0038772, now U.S. Pat. No. 7,999,787);
(p) application Ser. No. 11/461,084 (Publication No. 2006/0262060, now U.S. Pat. No. 7,453,445);
(q) copending application Ser. No. 11/751,879, filed May 22, 2007(Publication No. 2008/0024482); and
(r) application Ser. No. 11/845,919, filed Aug. 28, 2007 (now U.S. Pat. No. 8,174,490).

The entire contents of these copending applications, and of all other U.S. patents and published and copending applications mentioned below, are herein incorporated by reference.

BACKGROUND OF INVENTION

The present invention relates to methods for driving electro-optic displays, especially bistable electro-optic displays, and to apparatus for use in such methods. More specifically, this invention relates to driving methods which are intended to enable a plurality of drive schemes to be used simultaneously to update an electro-optic display. This invention is especially, but not exclusively, intended for use with particle-based electrophoretic displays in which one or more types of electrically charged particles are present in a fluid and are moved through the fluid under the influence of an electric field to change the appearance of the display.

The term "electro-optic", as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, several of the patents and published applications referred to below describe electrophoretic displays in which the extreme states are white and deep blue, so that an intermediate "gray state" would actually be pale blue. Indeed, as already mentioned the transition between the two extreme states may not be a color change at all.

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

The term "impulse" is used herein in its conventional meaning of the integral of voltage with respect to time. However, some bistable electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

Much of the discussion below will focus on methods for driving one or more pixels of an electro-optic display through a transition from an initial gray level to a final gray level (which may or may not be different from the initial gray level). The term "waveform" will be used to denote the entire voltage against time curve used to effect the transition from one specific initial gray level to a specific final gray level. Typically such a waveform will comprise a plurality of waveform elements; where these elements are essentially rectangular (i.e., where a given element comprises application of a constant voltage for a period of time); the elements may be called "pulses" or "drive pulses". The term "drive scheme" denotes a set of waveforms sufficient to effect all possible transitions between gray levels for a specific display.

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed to applying an electric field thereto, thus rotating the bodies to various positions and varying which of the sections of the bodies is seen through a viewing surface. This type of electro-optic medium is typically bistable.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002, 14(11), 845. Nanochromic films of this type are also described, for example, in U.S. Pat. Nos. 6,301,038; 6,870,657; and 6,950,220. This type of medium is also typically bistable.

Another type of electro-optic display is an electro-wetting display developed by Philips and described in Hayes, R. A., et al., "Video-Speed Electronic Paper Based on Electrowetting", Nature, 425, 383-385 (2003). It is shown in copending application Ser. No. 10/711,802, filed Oct. 6, 2004 (Publication No. 2005/0151709), that such electro-wetting displays can be made bistable.

Another type of electro-optic display, which has been the subject of intense research and development for a number of years, is the particle-based electrophoretic display, in which a plurality of charged particles move through a fluid under the influence of an electric field. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

As noted above, electrophoretic media require the presence of a fluid. In most prior art electrophoretic media, this fluid is a liquid, but electrophoretic media can be produced using gaseous fluids; see, for example, Kitamura, T., et al., "Electrical toner movement for electronic paper-like display", IDW Japan, 2001, Paper HCS1-1, and Yamaguchi, Y., et al., "Toner display using insulative particles charged triboelectrically", IDW Japan, 2001, Paper AMD4-4). See also U.S. Patent Publication No. 2005/0001810; European Patent Applications 1,462,847; 1,482,354; 1,484,635; 1,500,971; 1,501,194; 1,536,271; 1,542,067; 1,577,702; 1,577,703; and 1,598,694; and International Applications WO 2004/090626; WO 2004/079442; and WO 2004/001498. Such gas-based electrophoretic media appear to be susceptible to the same types of problems due to particle settling as liquid-based electrophoretic media, when the media are used in an orientation which permits such settling, for example in a sign where the medium is disposed in a vertical plane. Indeed, particle settling appears to be a more serious problem in gas-based electrophoretic media than in liquid-based ones, since the lower viscosity of gaseous suspending fluids as compared with liquid ones allows more rapid settling of the electrophoretic particles.

Numerous patents and applications assigned to or in the names of the Massachusetts Institute of Technology (MIT) and E Ink Corporation have recently been published describing encapsulated electrophoretic media. Such encapsulated media comprise numerous small capsules, each of which itself comprises an internal phase containing electrophoretically-mobile particles suspended in a liquid suspending medium, and a capsule wall surrounding the internal phase. Typically, the capsules are themselves held within a polymeric binder to form a coherent layer positioned between two electrodes. Encapsulated media of this type are described, for example, in U.S. Pat. Nos. 5,930,026; 5,961,804; 6,017,584; 6,067,185; 6,118,426; 6,120,588; 6,120,839; 6,124,851; 6,130,773; 6,130,774; 6,172,798; 6,177,921; 6,232,950; 6,249,271; 6,252,564; 6,262,706; 6,262,833; 6,300,932; 6,312,304; 6,312,971; 6,323,989; 6,327,072; 6,376,828; 6,377,387; 6,392,785; 6,392,786; 6,413,790; 6,422,687; 6,445,374; 6,445,489; 6,459,418; 6,473,072; 6,480,182; 6,498,114; 6,504,524; 6,506,438; 6,512,354; 6,515,649; 6,518,949; 6,521,489; 6,531,997; 6,535,197; 6,538,801; 6,545,291; 6,580,545; 6,639,578; 6,652,075; 6,657,772; 6,664,944; 6,680,725; 6,683,333; 6,704,133; 6,710,540; 6,721,083; 6,724,519; 6,727,881; 6,738,050; 6,750,473; 6,753,999; 6,816,147; 6,819,471; 6,822,782; 6,825,068; 6,825,829; 6,825,970; 6,831,769; 6,839,158; 6,842,167; 6,842,279; 6,842,657; 6,864,875; 6,865,010; 6,866,760; 6,870,661; 6,900,851; 6,922,276; 6,950,220; 6,958,848; 6,967,640; 6,982,178; 6,987,603; 6,995,550; 7,002,728; 7,012,600; 7,012,735; 7,023,420; 7,030,412; 7,030,854; 7,034,783; 7,038,655; 7,061,663; 7,071,913; 7,075,502; 7,075,703; 7,079,305; 7,106,296; 7,109,968; 7,110,163; 7,110,164; 7,116,318; 7,116,466; 7,119,759; 7,119,772; 7,148,128; 7,167,155; 7,170,670; 7,173,752; 7,176,880; 7,180,649; 7,190,008; 7,193,625; 7,202,847; 7,202,991; 7,206,119; 7,223,672; 7,230,750; 7,230,751; 7,236,290; and 7,236,292; and U.S. Patent Applications Publication Nos. 2002/0060321; 2002/0090980; 2003/0011560; 2003/0102858; 2003/0151702; 2003/0222315; 2004/0094422; 2004/0105036; 2004/0112750; 2004/0119681; 2004/0136048; 2004/0155857; 2004/0180476; 2004/0190114; 2004/0196215; 2004/0226820; 2004/0257635; 2004/0263947; 2005/0000813; 2005/0007336; 2005/0012980; 2005/0017944; 2005/0018273; 2005/0024353; 2005/0062714; 2005/0067656; 2005/0099672; 2005/0122284; 2005/0122306; 2005/0122563; 2005/0134554; 2005/0151709; 2005/0152018; 2005/0156340; 2005/0179642; 2005/0190137; 2005/0212747; 2005/0213191; 2005/0219184; 2005/0253777; 2005/0280626; 2006/0007527; 2006/0024437; 2006/0038772; 2006/0139308; 2006/0139310; 2006/0139311; 2006/0176267; 2006/0181492; 2006/0181504; 2006/0194619; 2006/0197736; 2006/0197737; 2006/0197738; 2006/0202949; 2006/0223282; 2006/0232531; 2006/0245038; 2006/0256425; 2006/0262060; 2006/0279527; 2006/0291034; 2007/0035532; 2007/0035808; 2007/0052757; 2007/0057908; 2007/0069247; 2007/0085818; 2007/0091417; 2007/0091418; 2007/0097489; 2007/0109219; 2007/0128352; and 2007/0146310; and International Applications Publication Nos. WO 00/38000; WO 00/36560; WO 00/67110; and WO 01/07961; and European Patents Nos. 1,099,207 B1; and 1,145,072 B1.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned U.S. Pat. No. 6,866,760. Accordingly, for purposes of the present application, such polymer-dispersed electrophoretic media are regarded as sub-species of encapsulated electrophoretic media.

An encapsulated electrophoretic display typically does not suffer from the clustering and settling failure mode of traditional electrophoretic devices and provides further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; and other similar techniques.) Thus, the resulting display can be flexible. Further, because the display medium can be printed (using a variety of methods), the display itself can be made inexpensively.

A related type of electrophoretic display is a so-called "microcell electrophoretic display". In a microcell electrophoretic display, the charged particles and the fluid are not encapsulated within microcapsules but instead are retained within a plurality of cavities formed within a carrier medium, typically a polymeric film. See, for example, U.S. Pat. Nos. 6,672,921 and 6,788,449, both assigned to Sipix Imaging, Inc.

Although electrophoretic media are often opaque (since, for example, in many electrophoretic media, the particles substantially block transmission of visible light through the display) and operate in a reflective mode, many electrophoretic displays can be made to operate in a so-called "shutter mode" in which one display state is substantially opaque and one is light-transmissive. See, for example, the aforementioned U.S. Pat. Nos. 6,130,774 and 6,172,798, and U.S. Pat. Nos. 5,872,552; 6,144,361; 6,271,823; 6,225,971; and 6,184,856. Dielectrophoretic displays, which are similar to electrophoretic displays but rely upon variations in electric field strength, can operate in a similar mode; see U.S. Pat. No. 4,418,346.

The aforementioned U.S. Pat. No. 7,119,772 contains a detailed explanation of the difficulties in driving bistable electro-optic displays as compared with conventional LCD displays, and the reasons why, under some circumstances, it may be desirable for a single display to make use of multiple drive schemes. For example, a display capable of more than two gray levels may make use of a gray scale drive scheme ("GSDS") which can effect transitions between all possible gray levels, and a monochrome drive scheme {"MDS") which effects transitions only between two gray levels, the MDS providing quicker rewriting of the display that the GSDS. The MDS is used when all the pixels which are being changed during a rewriting of the display are effecting transitions only between the two gray levels used by the MDS. For example, the aforementioned U.S. Pat. No. 7,119,772 describes a display in the form of an electronic book or similar device capable of displaying gray scale images and also capable of displaying a monochrome dialogue box which permits a user to enter text relating to the displayed images. When the user is entering text, a rapid MDS is used for quick updating of the dialogue box, thus providing the user with rapid confirmation of the text being entered. On the other hand, when the entire gray scale image shown on the display is being changed, a slower GSDS is used.

More specifically, present electrophoretic displays have an update time of approximately 1 second in grayscale mode, and 500 milliseconds in monochrome mode. In addition, many current display controllers can only make use of one updating scheme at any given time. As a result, the display is not responsive enough to react to rapid user input, such as keyboard input or scrolling of a select bar. This limits the applicability of the display for interactive applications. Accordingly, it is desirable to provide drive means and a corresponding driving method which provides a combination of drive schemes that allow a portion of the display to be updated with a rapid drive scheme, while the remainder of the display continues to be updated with a standard grayscale drive scheme.

One example of a controller used for illustrative purposes below accepts 8 bits of data per pixel, and has a transition matrix that specifies the frame-by-frame output of the source driver for each of the possible 8-bit pixel values. In a typical controller of this type, the 8 bit data represent the initial and final states of the pixel each specified by 4 bits per pixel (i.e., 16 gray levels).

In the aforementioned U.S. Pat. No. 7,119,772, the rapid MDS is typically a true monochrome drive scheme making use of the two extreme optical states of the medium. It has now been realized that in many cases a faster MDS drive scheme can be provided by using a "pseudo" monochrome drive scheme which uses at least one (and preferably two) gray levels other than the extreme optical states of the medium. Such gray levels other than the extreme optical states of the medium will herein after for convenience be called "intermediate gray levels". Although the contrast between two intermediate gray levels will of course be less than the contrast between the black and white extreme optical states of the medium, the intermediate gray levels can be chosen so that the contrast is entirely sufficient for many purposes, for example entering text in a dialog box.

SUMMARY OF THE INVENTION

This invention provides a method for updating a bistable electro-optic display having a plurality of pixels, and drive means for applying electric fields independently to each of the pixels to vary the display state of the pixel, each pixel having at least three different display states, the method comprising:

writing an image on the display using a first drive scheme capable of driving pixels to said at least three different display states; and thereafter varying the image on the display using a second drive scheme, the second drive scheme making use of only two gray levels, at least one of which is not an extreme optical state of the pixel.

In one form of this method, neither of the gray levels used in the second drive scheme is an extreme optical state of the pixel. Typically, the first drive scheme will make use of more than three optical states, for example 4, 16 or 64 optical states. Conveniently, each of the first and second drive schemes is stored as an N×N transition matrix, where N is the number of gray levels used in the first drive scheme. In order to facilitate the transition to the second drive scheme, the writing of the image on the display using the first drive scheme may comprise placing a contiguous group of pixels in one of the gray levels used by the second drive scheme. In a typical case where the pixels are arranged in a two-dimensional rectangular array, the contiguous group of pixels may be rectangular, and may be surrounded by a frame of pixels driven to a gray level not used by the second drive scheme. For reasons discussed below, it is desirable that both the first and second drive schemes be DC balanced.

The method of the present invention may be used with any of the types of bistable electro-optic medium discussed above. Thus, for example, the bistable electro-optic display may comprise a rotating bichromal member or electrochromic material. Alternatively, the bistable electro-optic display may comprise an electrophoretic material comprising a plurality of electrically charged particles disposed in a fluid and capable of moving through the fluid under the influence of an electric field. The electrically charged particles and the fluid may be confined within a plurality of capsules or microcells, or may be present as a plurality of discrete droplets surrounded by a continuous phase comprising a polymeric material. The fluid may be liquid or gaseous.

This invention also provides a bistable electro-optic display having a plurality of pixels, and drive means for applying electric fields independently to each of the pixels to vary the display state of the pixel, each pixel having at least three different display states, wherein the drive means is arranged to:

write an image on the display using a first drive scheme capable of driving pixels to said at least three different display states; and thereafter vary the image on the display using a second drive scheme, the second drive scheme making use of only two gray levels, at least one of which is not an extreme optical state of the pixel.

The bistable electro-optic display of the present invention may incorporate any of the optional features of the method of the present invention, as described above.

The displays of the present invention may be used in any application in which prior art electro-optic displays have been used. Thus, for example, the present displays may be used in electronic book readers, portable computers, tablet computers, cellular telephones, smart cards, signs, watches, shelf labels and flash drives.

DETAILED DESCRIPTION

Figure 1A:
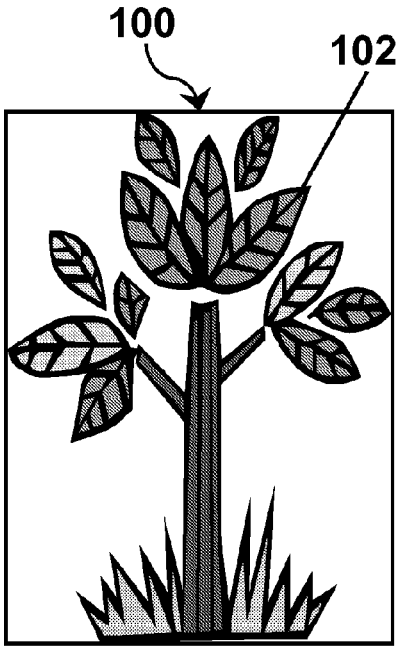
FIGS. 1A-1D of the accompanying drawings illustrate schematically various stages of a first method of the present invention used as the output of a program for entering keywords into an image database.

As already mentioned, this invention provides a method for updating a bistable electro-optic display using two different drive schemes. An image is written on the display using a first drive scheme capable of driving pixels to three (or typically more) different display states; and thereafter the image is varied using a second drive scheme, which makes use of only two gray levels, at least one of which is not an extreme optical state of the pixel.

As explained in more detail below, the present driving method is designed to provide a first drive scheme which can render gray scale images, while allowing for a more rapid drive scheme which is useful when it is necessary that the image respond quickly to user or other input. Experience with gray scale drive schemes shows that in such drive schemes some transitions can be effected more quickly than others and, of course, the overall transition time for an image change must be at least as long as the longest of the transitions in the overall drive scheme. It is typically found that it is possible to choose two gray levels such that there is an acceptable optical contrast between the gray levels (so that, for example, it is easy to read text written at one gray level against a background at the other gray level) but such that the transitions between the two gray levels are substantially shorter than the longest of the transitions in the gray scale drive scheme. It is then possible to use these two gray levels to provide a rapid "monochrome" drive scheme which can be used when rapid response of the display to user input is desired. In some cases, one of the gray levels chosen may be an extreme optical state of the pixel, while the other is an intermediate gray level. For example, in a 16-gray level display with the gray levels denoted 0 (black) to 15 (white), it might be possible to use levels 0 and 9 in the monochrome drive scheme.

One form of the present invention uses a set of two or more look-up tables to control the operation of a display controller. At least one of these look-up tables represents a gray scale drive scheme having 4 or more bits to specify gray levels. The other table represents is a fast drive scheme that switches between only two optical states that correspond closely to two of the gray states in the gray scale drive scheme. In one series of experiments, each waveform in the fast drive scheme consisted of a 180 ms square wave drive pulse followed by a 20 ms zero voltage period, for a total update time of 200 ms. The two end states of this drive scheme corresponded to gray states 4 and 14 (dark gray and nearly white) in a 4-bit gray scale drive scheme. In another experiment, each waveform of the fast drive scheme consisted of a 120 ms square wave drive pulse and 20 ms zero voltage period, and the end states corresponded to gray states 6 and 14 (medium gray and nearly white) in the same 4-bit gray scale drive scheme. These two fast drive schemes may hereinafter for convenience be referred to as the "4/14" and "6/14" schemes respectively.

The fast drive scheme should be "local" in character, i.e., the waveforms for pixels which do not undergo a change in optical state should have no discernible optical effect on the display. (Such waveforms for pixels not undergoing a change in optical state are often referred to as "leading diagonal elements" or "leading diagonal waveforms" since when, as is commonly the case, a drive scheme is represented graphically by a two-dimensional matrix in which each row represents the initial state of a pixel and each column the final state, the waveforms for so-called "zero transitions" not involving a change in optical state appear on the leading diagonal of the matrix.) More specifically, the most common implementation of a local drive scheme will have zero-voltage leading diagonal elements.

Furthermore, the fast drive scheme, which only acts between two optical states of the display, should be incorporated into an 8-bit transition matrix (as required by the controller) in the positions representing the transitions between the two corresponding gray states, while all other transitions should be zero. For example in 4/14 scheme above, the fast drive scheme would correspond to a transition matrix where the cells representing the 4->14 and 14->4 transitions contain the 180 ms square wave drive pulse of appropriate polarity, while all other cells are zero.

To set the display up for subsequent use of the fast drive scheme, an image is written on the display using the slow gray scale drive scheme, the image being chosen so that those pixels which will later be updated using the fast drive scheme are driven to one of the two gray states used in the fast drive scheme. For example, if the user wishes to search for content in the device using either the 4/14 or 6/14 fast drive scheme, a "search box" might be drawn consisting of a rectangle of pixels with optical state 14, surrounded by a thin boundary line with gray state 0 (black) to minimize the difference in visual appearance between the optical state 14 light gray box and any surrounding white (optical state 15) pixels.

In order to update the display in fast mode, the controller is instructed to use the fast drive scheme described above, and pixels are re-written only between the two gray levels 4 and 14 used in the fast drive scheme. Characters entered on to the keyboard are rendered by drawing them as objects of gray level 4 within the gray level 14 box. Characters can be deleted by re-writing them from gray level 4 to gray level 14. The fast drive scheme has no effect on any other pixels in the display because these pixels are constrained not to change, and the leading diagonal elements of the transition matrix are zero.

If, while the fast drive scheme is in use, it is necessary to change the background image (i.e., the image outside the search box), then the slow grayscale drive scheme is used to update the entire display (including the search box) and the entire image changes slowly.

As discussed in several of the patents and applications mentioned in the "Related Applications" section above, drive schemes that are DC-balanced are usually preferred for optimal long-term performance and product life in bistable electro-optic displays. A DC-balanced drive scheme can be simplified to a set of impulse potentials, one for each optical state, where the net impulse for a transition between any two optical states is equal to the difference between the impulse potentials of the two states. In general, it will not be possible to match the impulse potentials for the fast drive scheme optical states with those for the corresponding optical states in the slow drive scheme. Hence, it will be necessary to vary the pulse length, and therefore the impulse potential, of the fast drive scheme elements in order to most closely match the performance of existing states in the slow grayscale drive scheme.

Figure 1B:
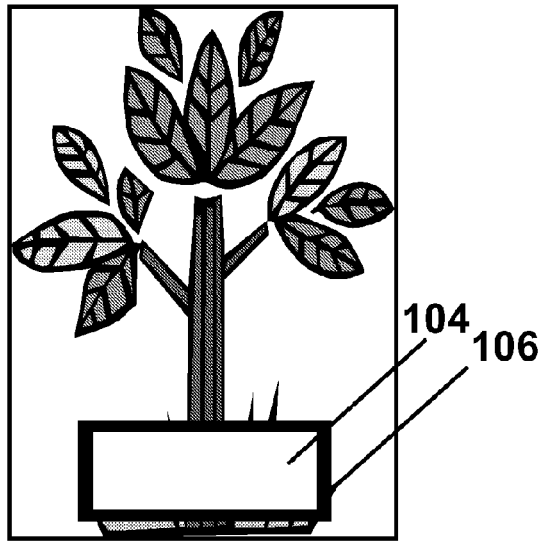

FIGS. 1A-1D of the accompanying drawings illustrate schematically one application of the first form of the present invention, namely its use in connection with a program for entering keywords into an image database. In FIG. 1A, a display (generally designated 100) displays an image 102 from the database, the image 102 being rendered in full gray scale using a relatively slow gray scale drive scheme. Suppose the user provides an input to display 100 indicating that he wishes to enter keywords relating to the image 102. As shown in FIG. 1B, the display 100 prepares for entry of keywords by modifying the displayed image 102 by inserting a text entry box 104 surrounded by a border 106. The box 104 and border 106 are provided by rewriting the display 100 using the slow gray scale drive scheme, with the pixels of the box 104 being set to gray level 14 (very light gray) and the pixels of the border 106 being set to gray level 0 (black).

Figure 1C:
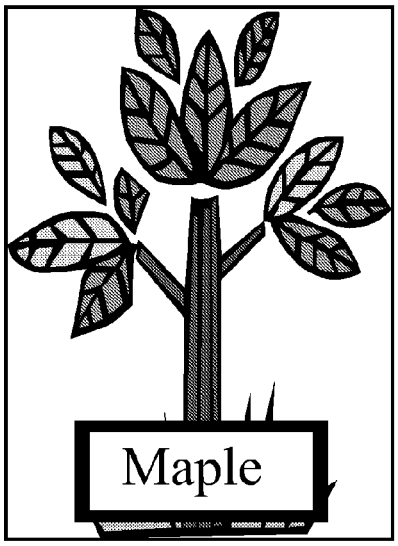

The display then switches to the aforementioned 6/14 fast drive scheme. Upon entry of keywords by the user, as shown in FIG. 1C, the entered text is rapidly displayed in the box 104 by writing the relevant characters as objects of gray level 6 (dark gray) against the gray level 14 background using the rapid 6/14 drive scheme. No change is effected in any part of the display outside the box 104, and since the display 100 is bistable, most of the image 102 is still available for review by the user.

Figure 1D:
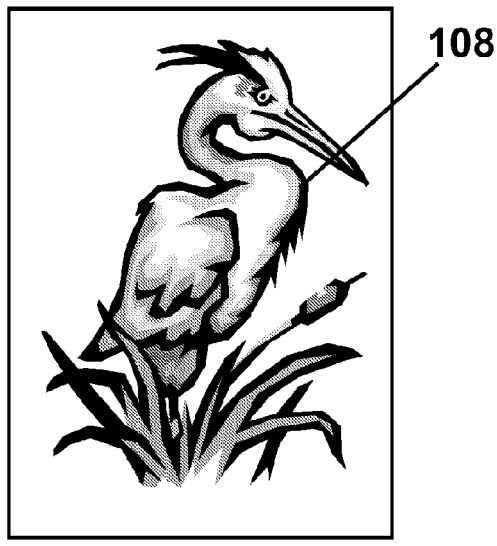

When the user has finished entering the desired keywords relating to the image 102, he enters an appropriate command (for example, pressing the ENTER key) and, as shown in FIG. 1D, the display 100 switches back to its slow gray scale drive scheme and writes the next image 108 from the image database on to the display 100, thereby eliminating the box 104 and border 106.

In a second form of the invention, the N data bits per pixel of a controller integrated circuit are re-partitioned to contain N−1 bits of image state information and 1 bit of region information. In this form of the invention, in order to enter the fast update mode, a region of the screen must be assigned to a new region (e.g., the region bit for the relevant pixels is set to 1), while the remainder of the screen remains in gray scale mode (region bit set to 0). The pixels in the new region are set only to one of the two gray levels of the fast drive scheme, typically black and white. The term "region" need not denote a compact, or even contiguous, area of the display but requires only that all pixels in the region have the same region bit value. For example, a region could consist of two discrete rectangles, or individual pixels scattered throughout the display, although most commonly a region will comprise one or more rectangular areas.

As in the previously described first form of the invention, in the second form it is likely that the optical states used in the fast drive scheme will not match the corresponding optical states reached with the slow grayscale drive scheme. Therefore, it may be necessary to create so-called "transfer waveforms" which can effect transition between optical states used in different drive schemes. For example, a transfer waveform might contain an element to transition a pixel from the black state in the grayscale drive scheme (region 0, state 0) to the black state in the fast drive scheme (region 1, state 0). This transfer waveform can be considered as being used to create a region, and thereafter used to eliminate all or part of this region, returning it to the ordinary grayscale drive scheme.

In order to implement a fast update in this second form of the invention, a data set is supplied to the controller in which all pixels with a region bit of 0 are assigned a zero voltage waveform, while pixels with a region bit of 1 are allowed to transition from black to white or vice versa (or between the other two optical states used by the fast drive scheme), using the fast drive scheme. It will be clear that, for this mode of operation to work correctly, pixels outside the fast-update region may be constrained to maintain the same optical state during the use of the fast drive scheme.

It is also possible to construct a hybrid drive scheme that allows gray scale transitions for pixels in region 0, while allowing fast transitions within region 1 by providing a drive scheme that has complete transition matrices for both regions. However, this hybrid updating scheme will require for each complete update a period of time equal to the length of the longest waveform in the drive scheme.

While this scheme is considerably more complex than that used in the first form of the invention, it has the advantage that the transfer waveforms ensure that the overall waveform is DC-balanced. If transfers into and out of fast-update mode have equal and opposite impulse, and the transitions within the fast-update mode are also DC-balanced, the system remains in DC balance.

This second form of the invention requires one additional feature. Using a single bit for the region code leaves only N−1 bits for the initial and final image information. Ordinarily, a drive scheme for n-bit images requires n bits of initial state information, and n bits of final state information, or 2n total bits; for example, a 4-bit image, requires 8 bits of storage. To accommodate a region bit without increasing overall storage requirements, it is necessary to reduce the state information to 7 bits, by reducing the initial state information to 3 bits. The necessary 3-bit value is normally obtained by omitting the least significant bit from the 4-bit initial state value.

Such truncation of initial state data results in neighboring initial states being treated identically for addressing purposes. For example, in such a drive scheme, the waveform used for the transition from white (state 15) to white would be identical to the waveform used for the transition from very light gray (state 14) to white. This truncation of the initial state data can introduce some error in the final optical state, but since the relevant initial states are optically similar (typically 3-4 L*apart), this error can be compensated for in the waveform.

By discarding part of the initial state information, there is also a risk of introducing DC imbalance into the drive scheme. The maximum DC imbalance per transition will be equal to the difference in impulse potential between the actual initial state, and that of the combined prior state. For example, suppose the impulse potential for state 15 is 20, and the impulse potential for state 14 is 15. The impulse potential for the condensed 14-15 prior state could be equal to that for either of the starting values (15 or 20), or it could be an intermediate value, for example 17.5. Therefore, a transition from 15->14->15 would introduce a DC imbalance of (20-15)+(17.5-20)=+2.5 units.

The risk of DC imbalance can be avoided by requiring that each of the combined initial states have the same impulse potential. Although it is usually the case that the impulse potential for each state is greater than that for the state of lower gray scale level, this is not required. Some of the patents and applications referred to in the "Related Applications" section above describe a class of waveforms for which all states have the same impulse potential, i.e., all transitions are individually DC balanced. Thus, if states 15 and 14 both had impulse potentials of 17.5, and the combined 15-14 state shared the same impulse potential, all transitions to, from or between these states would be DC-balanced.

FIGS. 2A-2D of the accompanying drawings illustrate schematically one application of the second form of the present invention to carry out essentially the same steps as in the first form of the invention illustrated in FIGS. 1A-1D, as described above. However, in order to illustrate the changes effected in the second form of the invention, the lower part of each of FIGS. 2A-2D shows a data register relating to one pixel of the display.

Figure 2B:
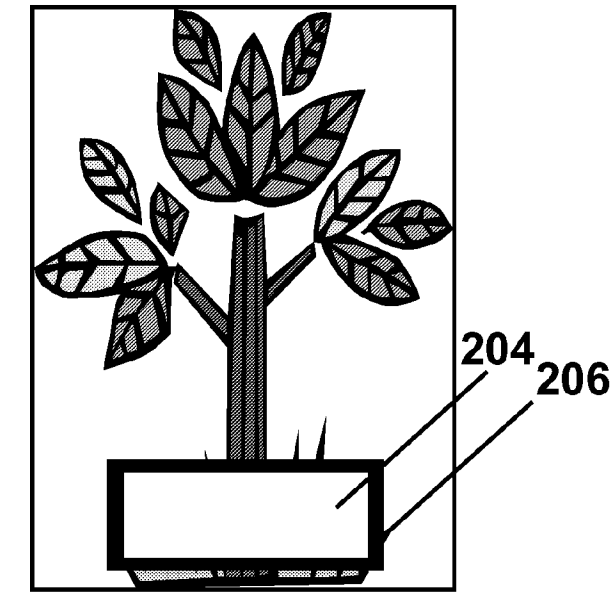
FIGS. 2A-2D illustrate schematically various stages of a second method of the present invention which carries out essentially the same steps as the first method illustrated in FIGS. 1A-1D, but also illustrate the various states of a data register relating to one pixel of the display.
Figure 2A:
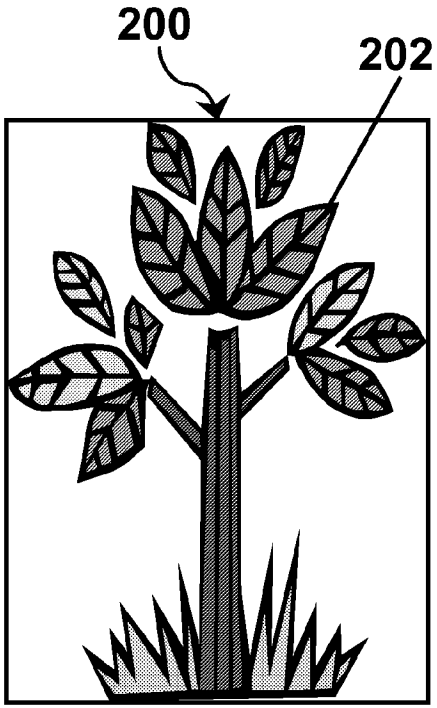

As illustrated in FIG. 2A, the second form of the invention begins in the same way as the first; a display (generally designated 200) displays an image 202 from the database, the image 202 being rendered in full grayscale using a relatively slow grayscale drive scheme. At this point, as illustrated in the lower part of FIG. 2A, the data register (generally designated 220, with individual bits designated 220A to 220H) stores four bits 220A-220D relating to the initial state (IS) of the relevant pixel (i.e., the gray level of the relevant pixel in the image displayed prior to image 202) and four bits 22A0E-220H relating to the final state (FS) of the relevant pixel (i.e., the gray level of the relevant pixel in image 202).

Again, as illustrated in FIG. 2B the user enters a command indicating that he wishes to enter keywords relating to the displayed image 202, whereupon a text box 204 surrounded by a border 206 is provided on the display 200. However, the mechanics of providing this text box 204 are different in the second form of the present invention. As illustrated in the lower part of FIG. 2B, bit 220A now becomes a region bit (RB) which is set to 1 for all pixels in the box 204 and border 206, but to 0 for other pixels of the display. This leaves only bits 220B-220D available to represent the initial state (IS) for a transition. (FIG. 2 assumes a least-significant-bit-first arrangement in the data register, so that using bit 220A for the region bit only eliminates the least significant bit of the initial image state.) The bits 220E-220H remain available for the final state (FS). A transfer waveform is then invoked to shift the pixel within the box 204 and border 206 from the various gray levels of the gray scale drive scheme to the two gray levels used by the rapid drive scheme. It should be noted that in region 1, bits 220E-220H representing the final gray level are set to 0001 or 0000 for the two gray levels used by the rapid drive scheme.

Figure 2C:
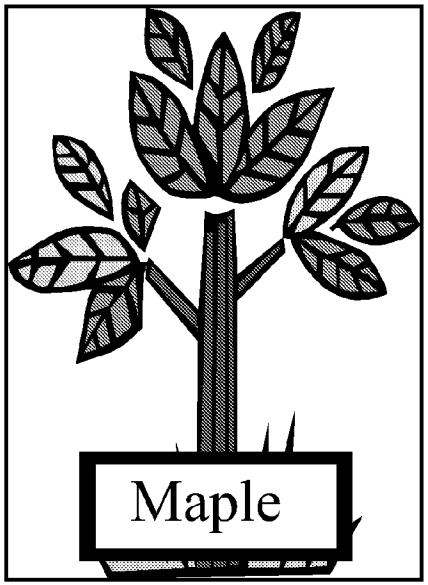
Figure 2D:
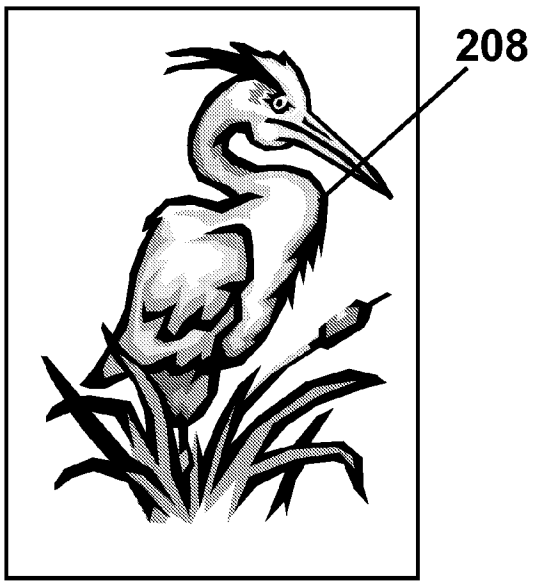

Thereafter, as illustrated in FIG. 2C, the rapid drive scheme is used to rewrite the text box 204 within region 1, but no changes are made in region 0, so that most of the image 202 remains on the bistable display 200 and is visible to the user. Finally, as shown in FIG. 2D, the next image is written on the display 200. However, the writing of this new image is somewhat more complicated than in the first form of the invention. A transfer drive scheme is applied to drive the pixels in region 1 from each of the two gray levels of the rapid drive scheme to one of the gray levels of the grayscale drive scheme; typically, all the pixels within region 1 will be driven to the same level of the grayscale drive scheme, although this is not strictly necessary. The four bit value of the gray level for each pixel within the region 1 is then placed in bits 220A-220D of the relevant register, but effectively abolishing the separate region 1, and thereafter the normal grayscale drive scheme is used to write the next image on the display, as shown in FIG. 2D.

From the foregoing description it will be seen that the present invention overcomes or substantially reduces the problem that many bistable electro-optic displays have update times too long to allow for a convenient interactive user interface; with such displays, text entry and menu selection do not allow quick navigation. Both forms of the present invention can allow the creation of full-speed user interfaces without the need for a change to the electro-optic material or the control electronics.

Numerous changes and modifications can be made in the preferred embodiments of the present invention already described without departing from the scope of the invention. Accordingly, the foregoing description is to be construed in an illustrative and not in a limitative sense.

The invention claimed is:

1. A method for updating a bistable electro-optic display having a plurality of pixels, and drive means for applying electric fields independently to each of the pixels to vary the display state of the pixel, each pixel having at least three different display states, the method comprising:

writing an image on the display using a first drive scheme capable of driving pixels to said at least three different display states; and thereafter varying the image on the display using a second drive scheme, the second drive scheme making use of only two gray levels, at least one of which is not an extreme optical state of the pixel.

2. A method according to claim 1 wherein neither of the gray levels used in the second drive scheme is an extreme optical state of the pixel.

3. A method according to claim 1 wherein the first drive scheme is capable of driving pixels to at least 16 different display states.

4. A method according to claim 1 wherein each of the first and second drive schemes is stored as an N×N transition matrix, where N is the number of gray levels used in the first drive scheme.

5. A method according to claim 1 wherein the writing of the image on the display using the first drive scheme comprises placing a contiguous group of pixels in one of the gray levels used by the second drive scheme.

6. A drive method according to claim 5 wherein the pixels are arranged in a two-dimensional rectangular array, and the contiguous group of pixels are rectangular.

7. A drive method according to claim 6 wherein the rectangular contiguous group of pixels are surrounded by a frame of pixels driven to a gray level not used by the second drive scheme.

8. A drive method according to claim 1 wherein both the first and second drive schemes are DC balanced.

9. A drive method according to claim 1 wherein the bistable electro-optic display comprises a rotating bichromal member or electrochromic material.

10. A drive method according to claim 1 wherein the bistable electro-optic display comprises an electrophoretic material comprising a plurality of electrically charged particles disposed in a fluid and capable of moving through the fluid under the influence of an electric field.

11. A drive method according to claim 10 wherein the electrically charged particles and the fluid are confined within a plurality of capsules or microcells.

12. A drive method according to claim 10 wherein the electrically charged particles and the fluid are present as a plurality of discrete droplets surrounded by a continuous phase comprising a polymeric material.

13. A drive method according to claim 10 wherein the fluid is gaseous.

14. A bistable electro-optic display having a plurality of pixels, and drive means for applying electric fields independently to each of the pixels to vary the display state of the pixel, each pixel having at least three different display states, wherein the drive means is arranged to:

write an image on the display using a first drive scheme capable of driving pixels to said at least three different display states; and thereafter vary the image on the display using a second drive scheme, the second drive scheme making use of only two gray levels, at least one of which is not an extreme optical state of the pixel.

15. A bistable electro-optic display according to claim 14 wherein neither of the gray levels used in the second drive scheme is an extreme optical state of the pixel.

16. A bistable electro-optic display according to claim 14 wherein the first drive scheme is capable of driving pixels to at least 16 different display states.

17. A bistable electro-optic display according to claim 14 further comprising storage means arranged to store each of the first and second drive schemes as an N×N transition matrix, where N is the number of gray levels used in the first drive scheme.

18. A bistable electro-optic display according to claim 14 comprising a rotating bichromal member or electrochromic material.

19. A bistable electro-optic display according to claim 14 comprising an electrophoretic material comprising a plurality of electrically charged particles disposed in a fluid and capable of moving through the fluid under the influence of an electric field.

20. A bistable electro-optic display according to claim 19 wherein the electrically charged particles and the fluid are confined within a plurality of capsules or microcells.

21. A bistable electro-optic display according to claim 19 wherein the electrically charged particles and the fluid are present as a plurality of discrete droplets surrounded by a continuous phase comprising a polymeric material.

22. A bistable electro-optic display according to claim 19 wherein the fluid is gaseous.

23. An electronic book reader, portable computer, tablet computer, cellular telephone, smart card, sign, watch, shelf label or flash drive comprising a display according to claim 14.

* * * * *